United States Patent [19]

Yacaboni

[11] Patent Number: 4,720,947

[45] Date of Patent: Jan. 26, 1988

[54] DOME-SHAPED BUILDING STRUCTURE

[76] Inventor: Joseph D. Yacaboni, P.O. Box 1606, Lake Placid, Fla. 33852

[21] Appl. No.: 929,070

[22] Filed: Nov. 10, 1986

Related U.S. Application Data

[62] Division of Ser. No. 731,475, May 7, 1985, Pat. No. 4,663,898.

[51] Int. Cl.[4] ..... E04D 1/32; E04D 1/98; E02D 27/34; E04H 9/02

[52] U.S. Cl. ..... 52/81; 52/80; 52/82; 52/167; 52/295

[58] Field of Search ..... 52/80, 81, 295, 167, 52/143, 82

[56] References Cited

U.S. PATENT DOCUMENTS

| | | | |
|---|---|---|---|
| 1,530,951 | 3/1925 | Krauss | 52/295 |
| 1,728,164 | 9/1929 | Burede | 52/295 |
| 1,874,359 | 8/1932 | Rutherford | 52/295 |
| 1,970,404 | 8/1934 | Tesch | 52/81 |
| 1,979,580 | 11/1934 | Spring | 52/295 |
| 2,278,956 | 4/1942 | Wagner | 52/81 |
| 3,894,367 | 7/1975 | Yacoboni | 52/80 |
| 3,906,689 | 9/1975 | Nakayama | 52/167 |
| 4,001,990 | 1/1977 | Case et al. | 52/167 |
| 4,133,150 | 1/1979 | Yacoboni | 52/80 |
| 4,188,681 | 2/1980 | Jada et al. | 52/167 |
| 4,189,892 | 2/1980 | Smith | 52/143 |

FOREIGN PATENT DOCUMENTS

| | | | |
|---|---|---|---|
| 896836 | 4/1972 | Canada | 52/80 |
| 38382 | 10/1981 | European Pat. Off. | 52/80 |
| 3008131 | 9/1981 | Fed. Rep. of Germany | 52/80 |
| 557869 | 8/1923 | France | 52/80 |
| 1525983 | 9/1978 | United Kingdom | 52/80 |
| 2130620 | 6/1984 | United Kingdom | 52/80 |

*Primary Examiner*—William F. Pate, III
*Assistant Examiner*—Michael Safavi
*Attorney, Agent, or Firm*—George B. Oujevolk

[57] ABSTRACT

An improved dome-type structure having a plurality of load bearing rib elements extending upwards from a base and meeting at a common vertex, a roof deck extending over and supported by these rib elements and vertical side panels are all disposed so as to form an enclosure. The improvement comprises using components for forming the roof deck which are generally trapezoidal and rectangular in shape. The structure is assembled with the interconnection of the trapezoidal and rectangular-shaped components with and without structural ribs which are of inverted T-shape in cross-section. A water trap is provided at one or more places around the base of the structure, and, in locations where there is a scarcity of water, an underground reservoir is provided beneath the structure. The arrangement provides protection against earthquakes and earth tremors.

The invention also contemplates the transportation of a complete shell unit under its own power by air lift.

1 Claim, 17 Drawing Figures

DOME-SHAPED BUILDING STRUCTURE

This application is a divisional application of U.S. patent application Ser. No. 06/731,475 filed May 7, 1985 now U.S. Pat. No. 4,663,898.

BACKGROUND OF THE INVENTION

This invention relates to a housing structure generally having a dome-type configuration and to a method for buildling the same.

BRIEF DESCRIPTION OF THE PROBLEM

The provision of adequate housing facilities for modern man is and has always been a perplexing and expensive problem. The costs of labor and of material prevent lowincome families from obtaining adequate housing. Consequently, such families are forced to tolerate and to live in the squalor and filth of ghetto districts.

In an effort to solve the absence of satisfactory housing facilities, modern man has razed ghetto buildings whereupon low income families are forced to move on in search of new dwellings and to await the reconstruction of a sterile, impersonal, high-rise apartment complex. Unfortunately, the interim period of wait is long, unnecessary delay requiring many months before the first family can return to its remodeled district.

The bigger the high-rise apartment complex the longer its construction time and the longer a family is deprived of adequate housing. Also, there are attendant labor costs and production hours interspersed with labor difficulties which contribute to the spiraling construction costs.

There has been a long-felt need for economic and commodious housing facilities for low-income families. Such facilities must be commodious and accommodate an averagesized family. The structure and architecture of such facilities must be pleasing and have some esthetic value and inherent beauty. The structure should be sturdy and relatively easy to construct with low-cost but adequate building materials. The time required to construct such facilities should be very short such that the delay of transfering families is minimal. Each family unit should be isolated so that each family has some degree of privacy, of independence and of individuality.

In my invention described in U.S. Pat. No. 3,894,367 I have described an answer to these long-felt needs. I have described a novel dome-shaped structure which fulfills these needs and have developed a method of erecting such a structure within a greatly reduced period of time as compared to the time needed to build conventional structures. The design of my structure is flexible and it may be adapted to meet a wide range of floor space requirements and the like depending upon the various circumstances. it has a configuration which is inherently beautiful and pleasing and through inexpensive landscaping techniques it naturally blends in with the surrounding environment without intruding upon the natural beauty of the environment.

The present invention is directed to a simplification of the dome-shaped structure of my previous inventions which is easier and cheaper to produce, as well as to other desirable features.

SUMMARY OF THE INVENTION

Generally speaking, the present invention contemplates an improvement in a dome-type structure which may be supported by a plurality of load bearing elements extending upwards from the base meeting at a common vertex. A roof deck extends over and is supported by these structural elements and vertical side panels are all disposed so as to form an enclosure. The improvement generally comprises using components for the structural elements which are generally trapezoidal and retangular in shape. The structure is assembled mostly with the interconnection of the trapezoidal and rectangular-shaped components with or, without the load bearing elements. A water trap is provided at one or more places around the base of the structure, and, in locations where there is a scarcity of water, an underground reservoir is provided beneath the structure. The arrangement provides protection against earthquakes or earth tremors. Also, a complete shell unit can be transported by air lift.

The invention as well as other objects and advantages will be better understood from the following detailed description when taken together with the accompanying drawings, in which:

DETAILED DESCRIPTION

The Dome-Shaped Structure

Figure 1:
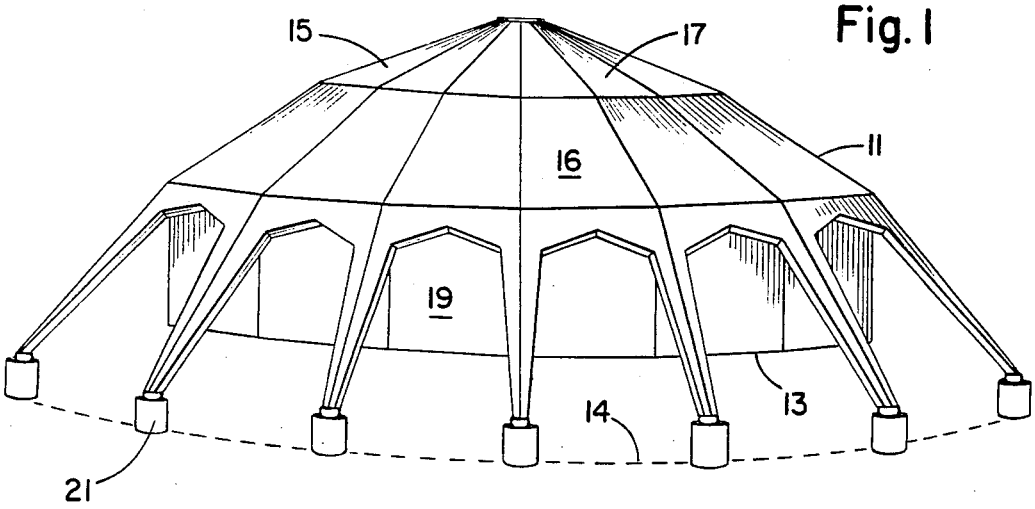
FIG. 1 presents a perspective view of an embodiment of a housing structure according to the inventive concept.
Figure 10:
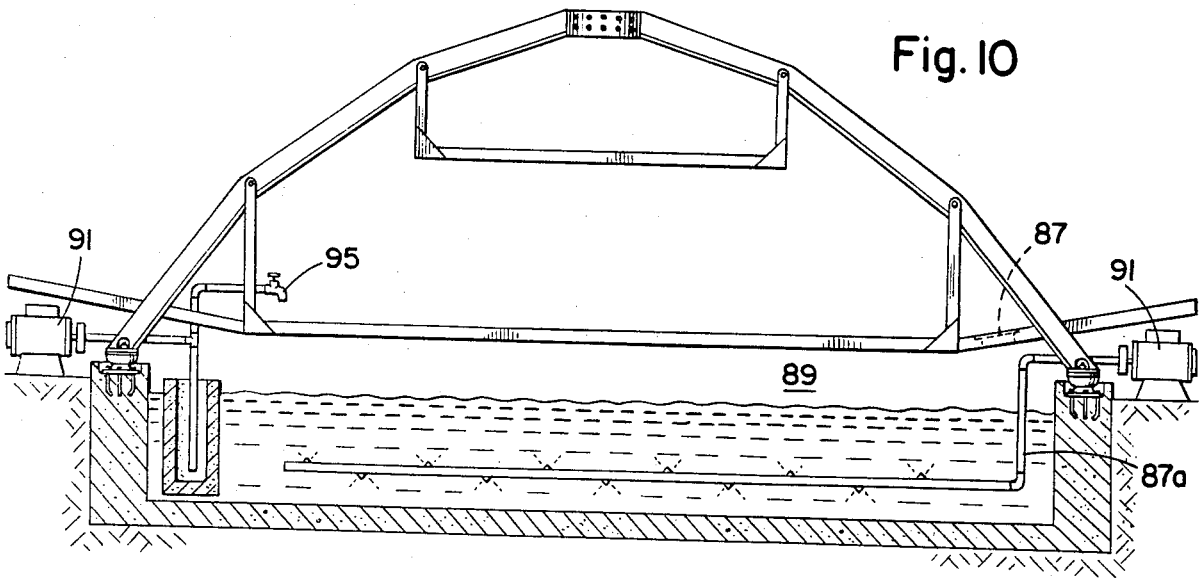
FIG. 10 illustrates a profile view of a reservoir.
Figure 10A:
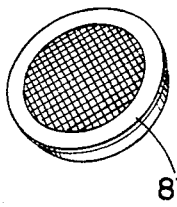
FIG. 10*a* shows a perspective view of a reservoir water trap.
Figure 10B:
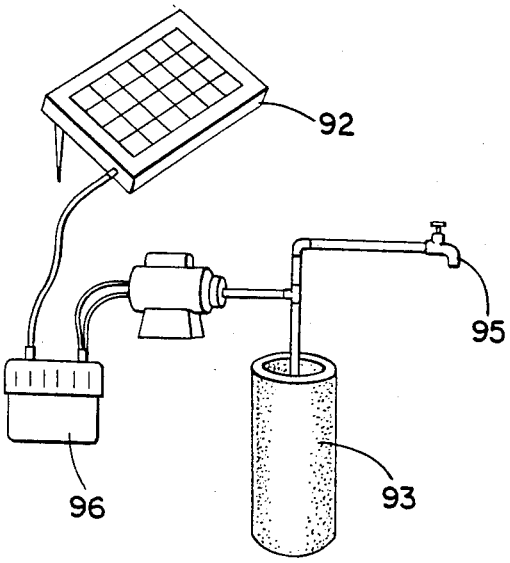
FIG. 10*b* is a perspective view of a filter for a reservoir.
Figure 2A:
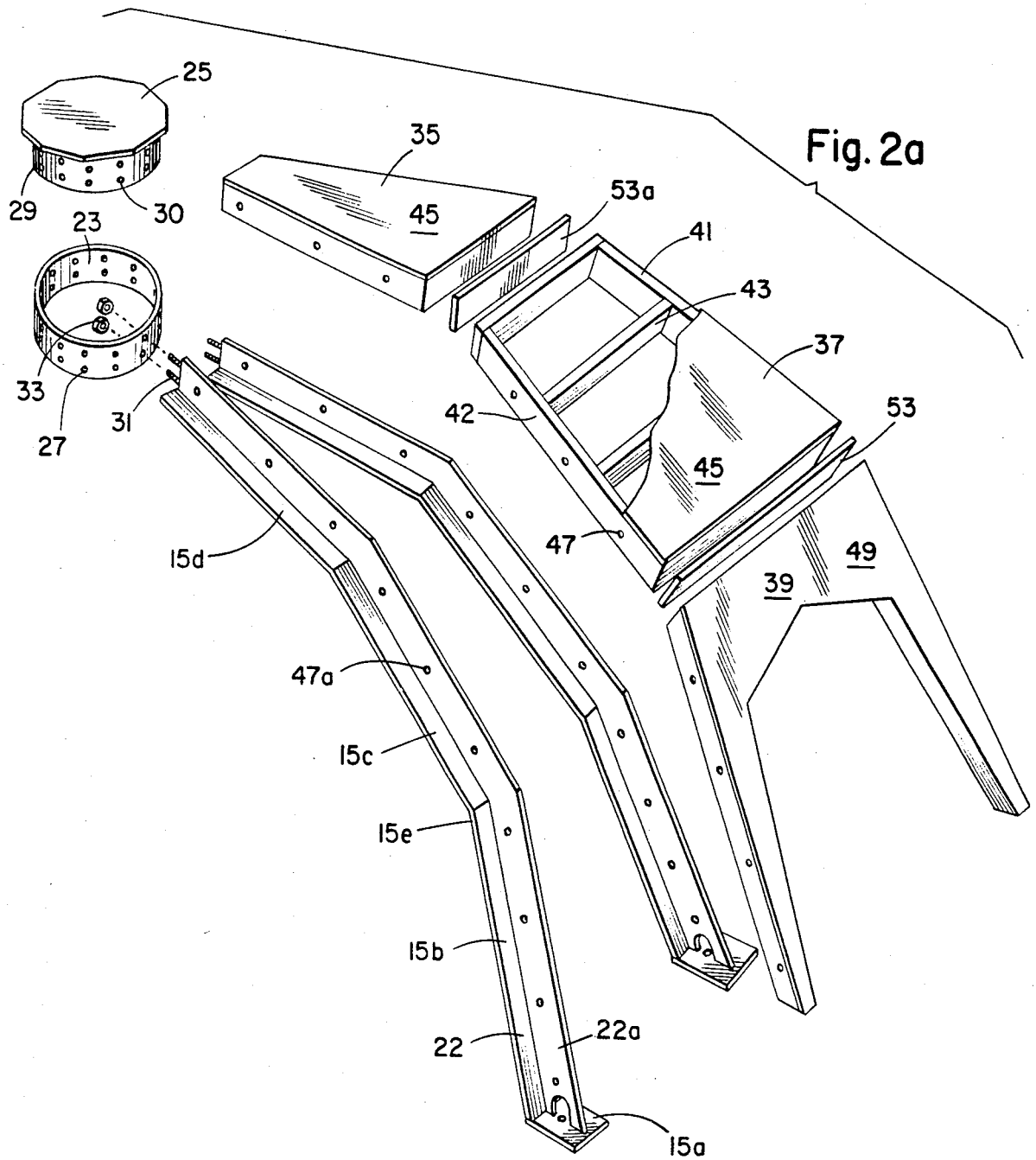
FIG. 2*a* is a perspective view of some of the structural rib elements used together with trapezoidal components in forming a dome structure.
Figure 2B:
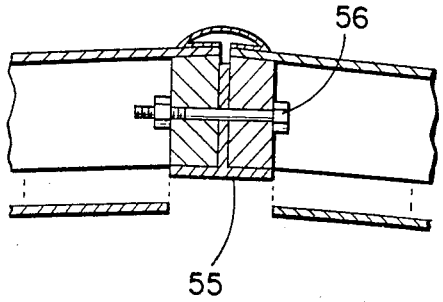
FIG. 2*b* presents an isolated view of an arangement to couple two trapezoidal components.

In accordance with the invention, the housing structure 11 has a base 13, a plurality of support ribs 15, which support trapezoidal and substantially rectangular panels 16, assembled to form a top covering or roof 17 and a plurality of walls or side panels 19.

The base 13 is made of wood or is a concrete slab and has a substantially circular perimeter 14, and rests on the earth as a foundation, supporting the side panels 19. A wooden floor also rests on the base with support from the side panels. Concrete pilings 21 which are set in the earth support the structure. it is also possible to construct a semi-dome in which case the wood or concrete slab would have a semicircular configuration.

According to one aspect of the invention, the cross-sectional configuration of the structural elements or ribs 15 is inverted T-shaped as seen more clearly in the drawings. These structural elements or ribs 15 have a base portion 15*a* composed of structural steel. Base portions 15*a* serve to fix the ribs 15 to concrete pilings as hereafter described.

The Dome-Shaped Assembly

The housing structure 11 achieves its dome shape and strength by means of a multiplicity of trapezoidal sections which can be bolted together with out steel Ts or disposed on ribs 15. According to the first concept, T-shaped ribs are used. These ribs 15, are inverted T-shaped in cross section, the bottom of the inverted T-shape being a horizontal beam 22, the vertical portion of the inverted T-shape (steel T) also being a steel beam 22*a*, are first assembled in three sections, namely a lower section 15*b*, a center section 15*c* and an upper section 15*d*. Each section extends inwardly of the preceeding section and are joined together at joints 15*e*. At the top of the dome-like structure is a coupling ring 23 with a ring cover 25. Coupling ring 23 has apertures 27, and the ring cover 25 has a lower inner ring 29 which fits inside the coupling ring 23 with corresponding apertures 30. The upper rib section 15*d* has bolts 31 placed so as to enter the apertures 27, 30 in the coupling ring 23 and the inner ring 29. The ring cover 25, ring and rib upper section 15*d* are thus bolted together by nuts 33. The coupling of the lower rib section 15*b* to base 13 will be described later herein.

As herein before explained according to the first concept ribs 15 are of inverted T-shape, and fitted between two adjacent ribs 15, resting on one wing of each inverted T-shaped rib are trapezoidal sections. The top trapezoidal section 35 rests between two adjacent upper rib sections 15*d*. The second trapezoidal section 37 rests on center rib sections 15*c*. Resting on the lower rib section 15*b* is an inverted U-shaped support 39. Each trapezoidal section and support 39 consists of a frame, 41 with several ladder-like rungs 43, side panels 42 and top and bottom thermoplastic covers 45 nailed to the frame. The frames have apertures 47 and the ribs 15 have corresponding apertures 47*a* allowing the trapezoidal sections and the U-shaped supports to be bolted to the ribs. The inverted U-shaped support 39 has a support top 49 with legs 51. The various trapezoidal sections and the U-shaped supports with the legs are connected using foam strips 53, 53*a*, T-shaped couplings 55 with nuts and bolts 56. The foam strips 53, 53*a* are asphalt impregnated that will expand and seal two sections.

According to a second embodiment, it is also possible to assemble the structure without using T-shaped ribs. The trapezoidal sections 45*a* and the U-shaped supports 39*a* have solid end walls 43*a* which are bolted together by nuts and bolts 56*a*, advantageously using s shim 53*a* which is asphalt impregnated to seal the two sections.

Figure 3B:
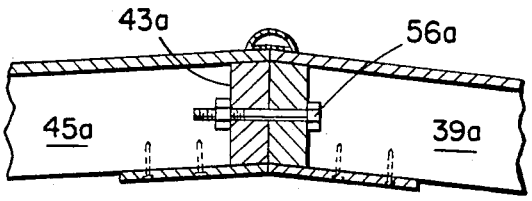
FIG. 3*b* presents an isolated view of an arrangement to couple two trapezoidal components without structural ribs.
Figure 3A:
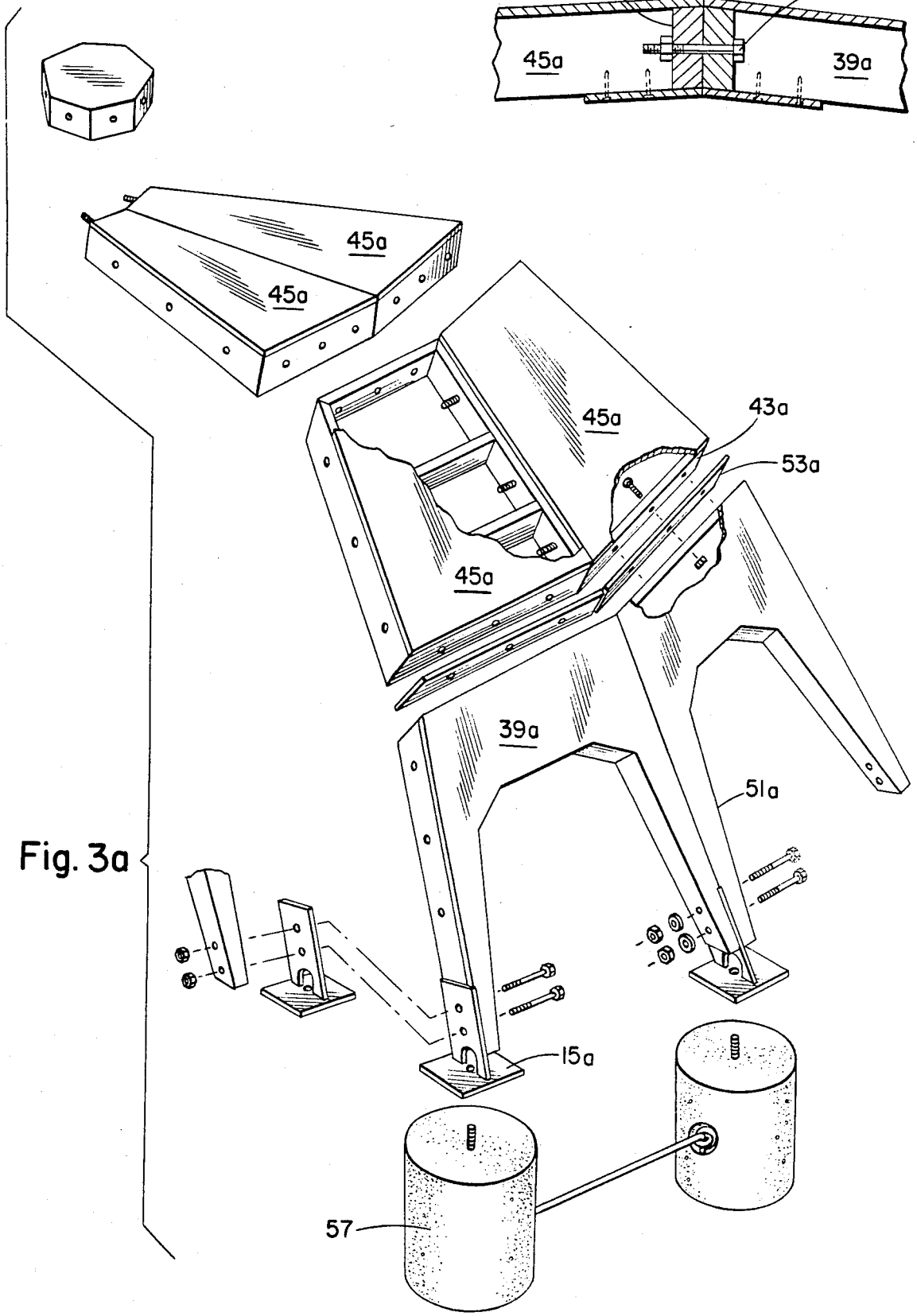
FIG. 3*a* shows in a view similar to FIG. 2*a* elements used to form a dome structure without the use of rib elements.
Figure 4:
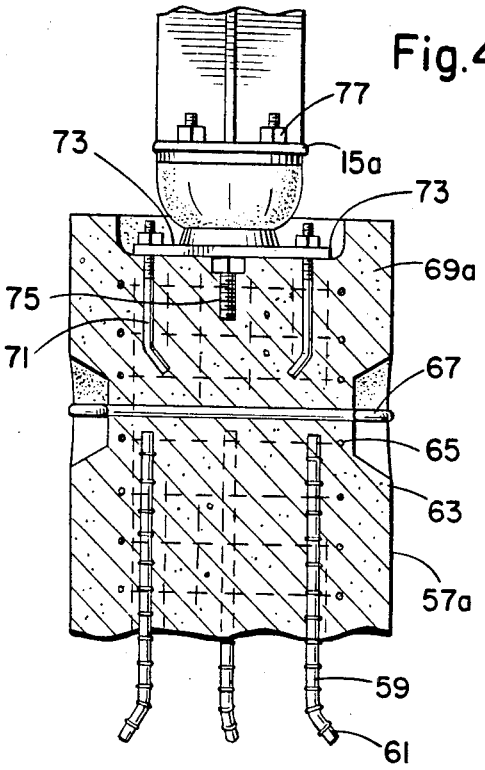
FIG. 4 shows a partly sectional and partly perspective view of an air actuator and a steel plate anchor assembly on a concrete foot pier.
Figure 5:
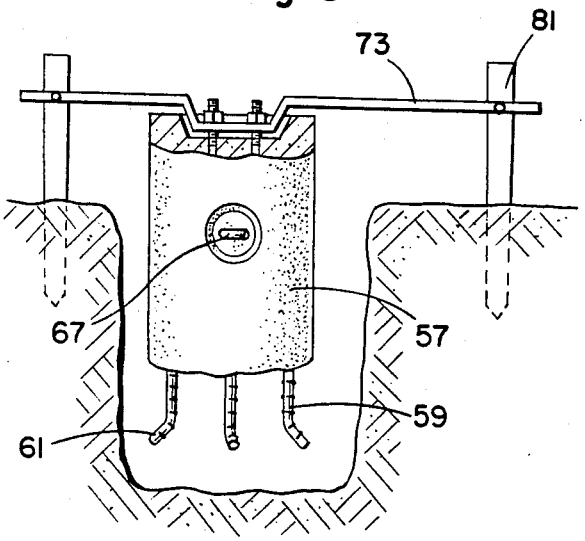
FIG. 5 illustrates a method of installing a shop built foot pier for the housing structure.
Figure 6:
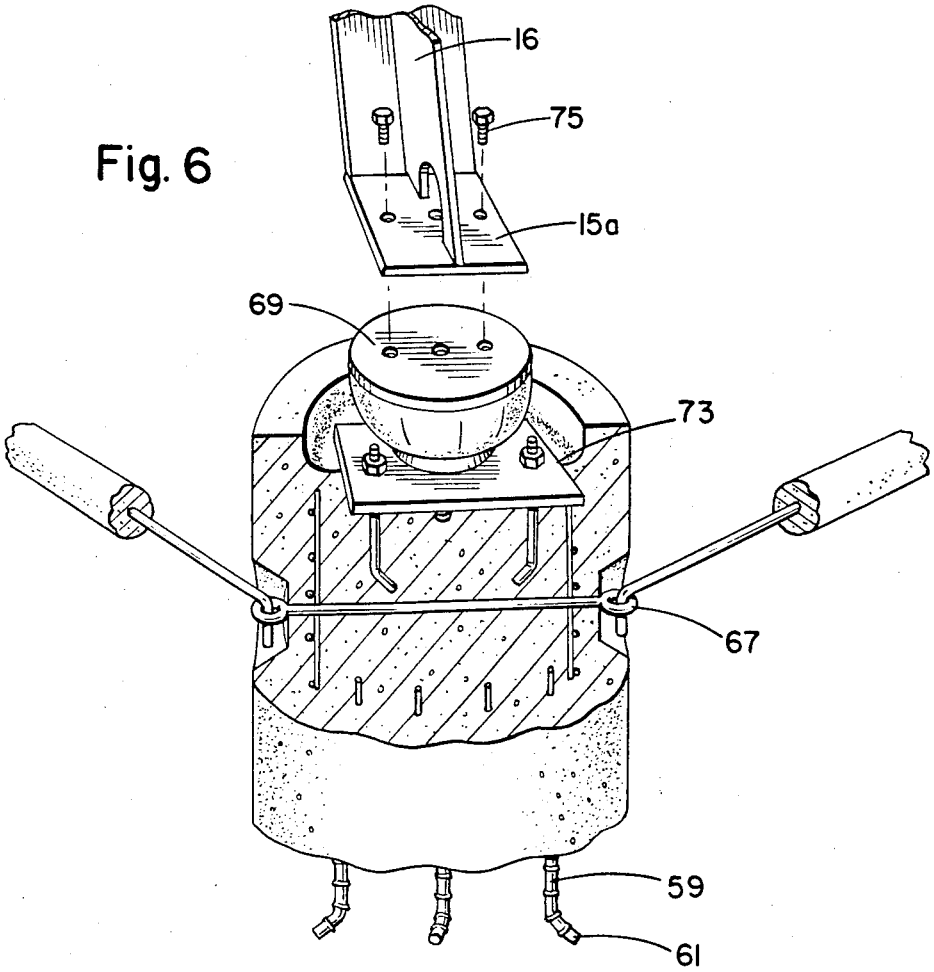
FIG. 6 is a perspective view of another arrangement to couple the structure to a foot pier.
Figure 7:
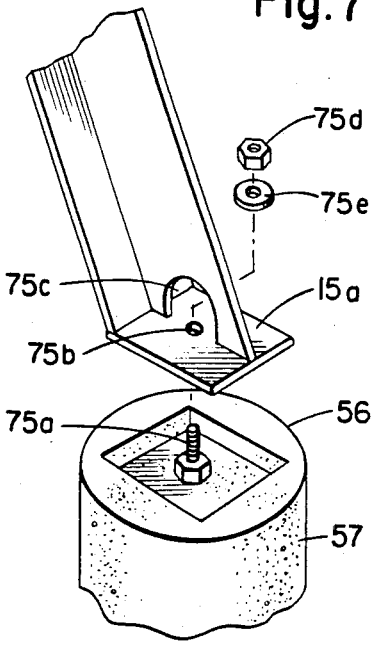
FIG. 7 illustrates a very simple arrangement as to how to connect a support rib to a concrete pier.
Figure 8:
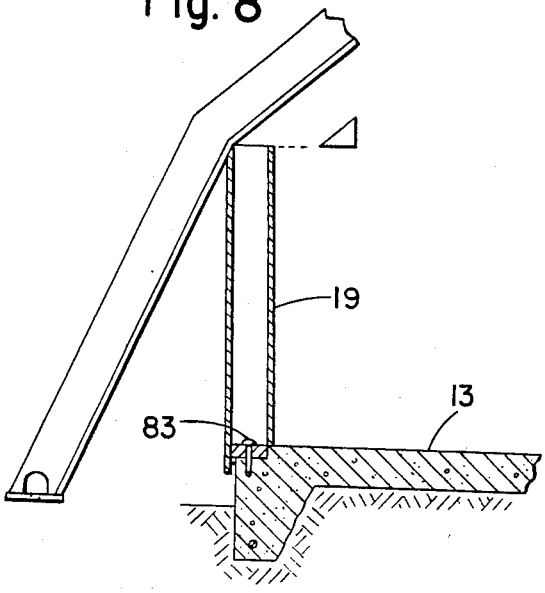
FIG. 8 presents a side view of a wall side panel and its connection.
Figure 9:
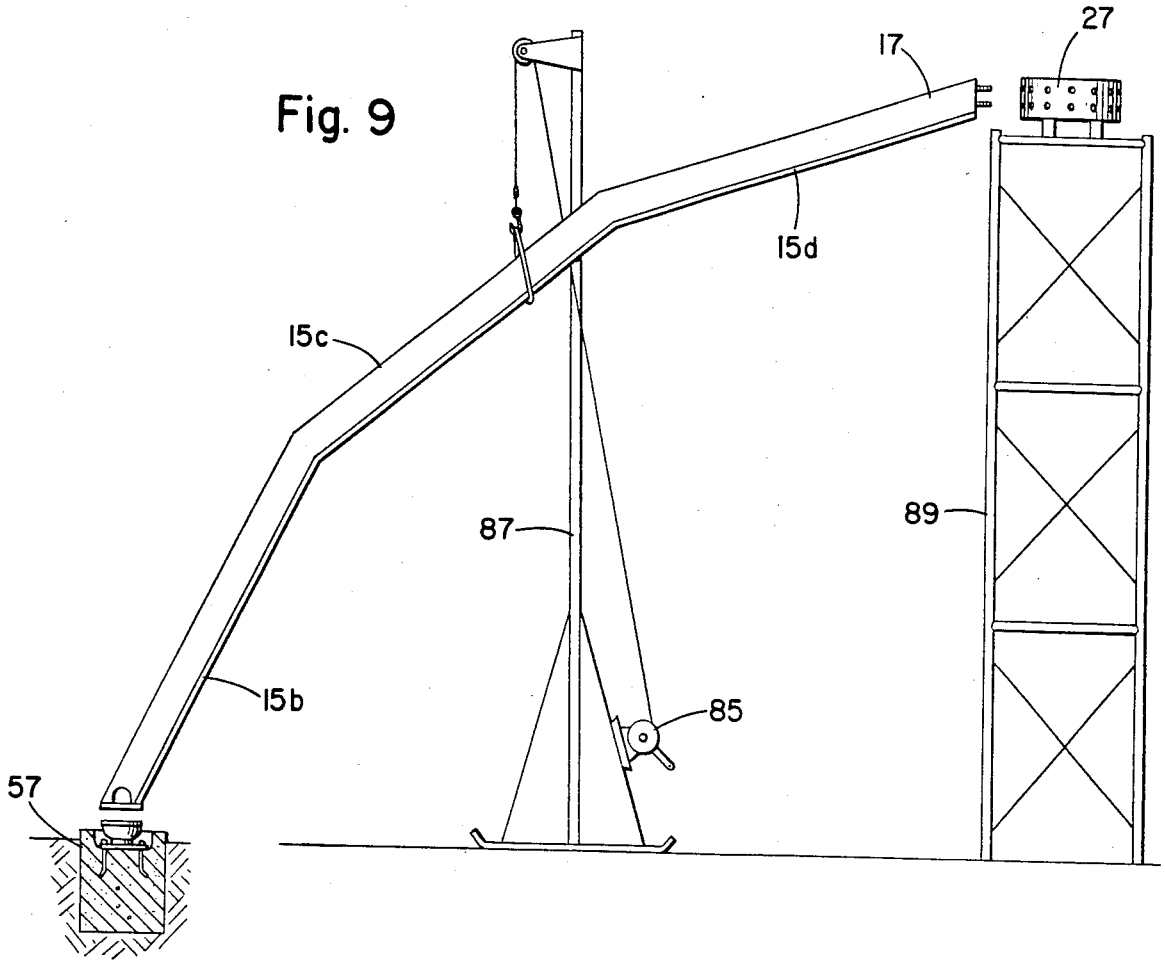
FIG. 9 explains in a perspective view a simple erection method of the dome assembly using a boat winch and a portable scaffolding.

In this second embodiment, there is also a base 15*a* attached to the legs 51*a*, said base 15*a* having an inverted T-shaped cross-section as shown in FIG. 3*a*, the bottom horizontal section being used in bolting the legs 51*a* to a pier.

ANCHORING THE STRUCTURE

The structure contemplated herein can be supported by shop built piers 56. These can be a simple block 57 or a more solid pier 57*a*. This more solid arrangement uses vertical rods 59 with hook ends 61. The pier is made of concrete 63 poured in a mold reinforced with wire mesh 65 and has a steel eyelet 67 used in coupling. The pier is coupled to the rib base 15*a* using an air actuator 69 commercially referred to as an airstroke actuator, which has lower concrete anchor rods 71 bolted to a steel plate 73 at the base of this air actuator 69. The steel plate 73 in turn is bolted to the air actutor 69 by bolt means 75. The top of the actuator 69 is in turn bolted to the support rib base 15*a* by bolts 77. The steel plate 73 extends out over the pier and the outer ends are supported by posts 81.

The wall side panels 19 are much easier to erect since they are bolted to the base 13 by bolts 83. In some situations, a simpler arrangement can be used to couple the rib base 15*a* to a concrete pier 56. The pier 56, has a central bolt 75*a* which passes through an aperture 75*b* in the rib base 15*a*. The bottom of rib 15 has a vertical space 75*c* which serves to receive the bolt 75*a*. A nut 75*d* and a washer 75*e* are then used to couple the rib 15 to the concrete pier 56.

THE ERECTION OF THE DOME STRUCTURE

In erecting the dome structure with ribs, the lower rib 15*b* is coupled to the pier 57. Then, using a boat winch 85, and an erection jig 87, the second rib 15*c* is put into place. A freme 89 is erected to hold the roof 17 and the coupling ring 27 is removably attached to the top of the frame 89. The last rib 15*d* is then set in place between the center ribs 15*c* held by the jig 87 and the winch 85, and the coupling ring 27. In the same way, the other ribs are set in place, then the trapezoidal pieces are fitted between the ribs.

It is important to note however that the structure can be built without steel beams or ribs. With prepunched holes, nuts and bolts the structure can be easily erected by persons without building experience and can be shipped flat long distances.

THE RESERVOIR

The dome construction described lends itself to use in areas where there is a scarcity of water and also in places which are earthquake prone, since a reservoir can be placed underneath the dome-like structure. All the roof and deck rain water are directed to flow to water traps 87 disposed around the base 17 of the structure. The reservoir 89 is round which is stronger than square shape and is disposed under the structure. Small motors 91 pump air into the water and are used to pump the water upwards, advantageously, these motors are powered by solar cells 92 and battery 96. The water flows upwards through a filter 93 to a water tap 95. Also filters are placed on all over flow lines 87*a* and water traps 87.

THE AIRBORN STRUCTURE

Figure 11A:
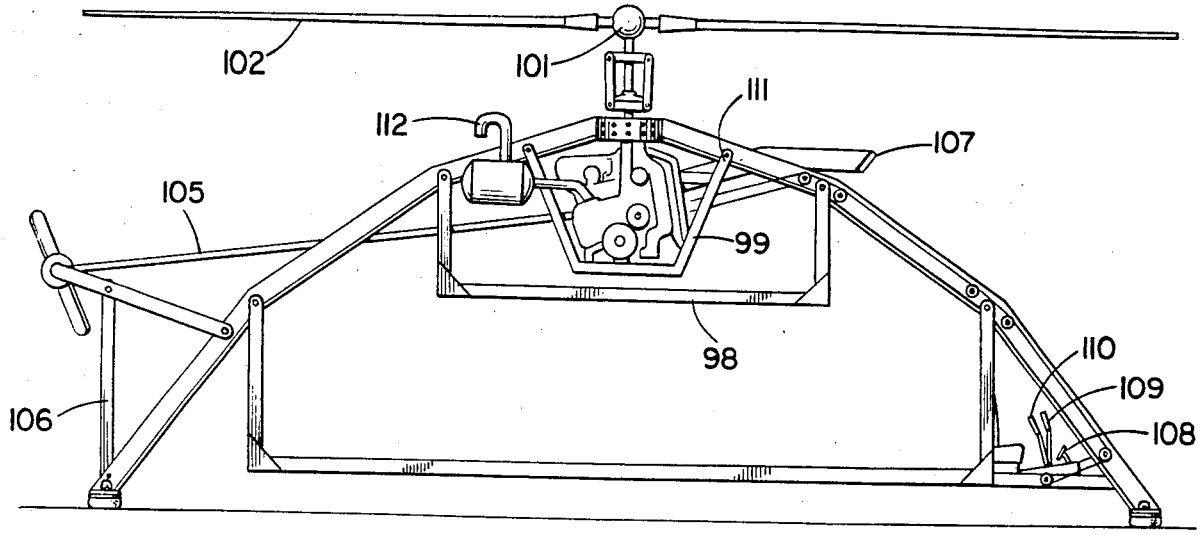
FIG. 11*a* illustrates a profile of a method of transporation for a dome.
Figure 11B:
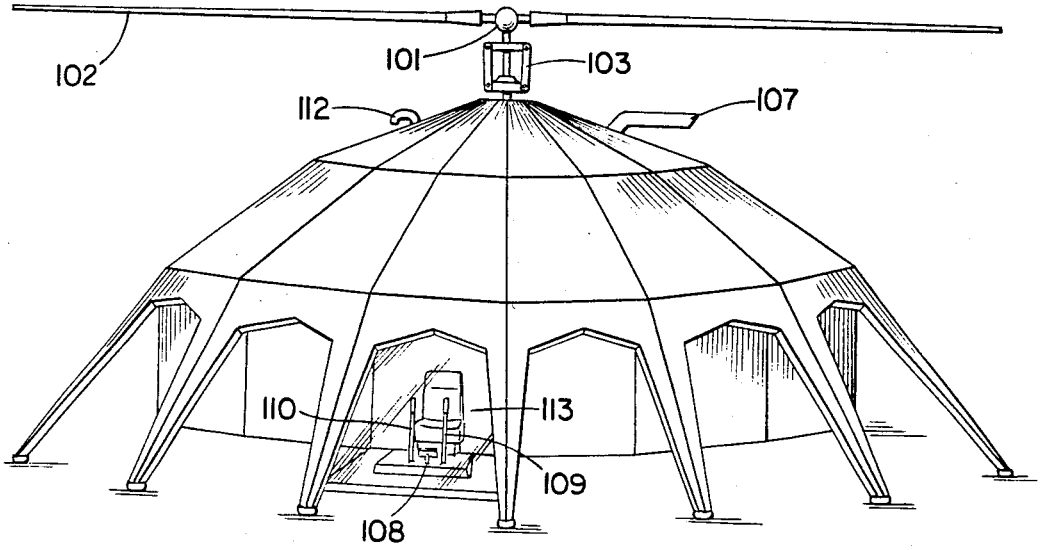
FIG. 11*b* is a perspective view of the arrangement shown in FIG. 11*a;* and, FIG. 12 is a longitudinal explanation of a dome shaped structure with suspended floors.
Figure 12:
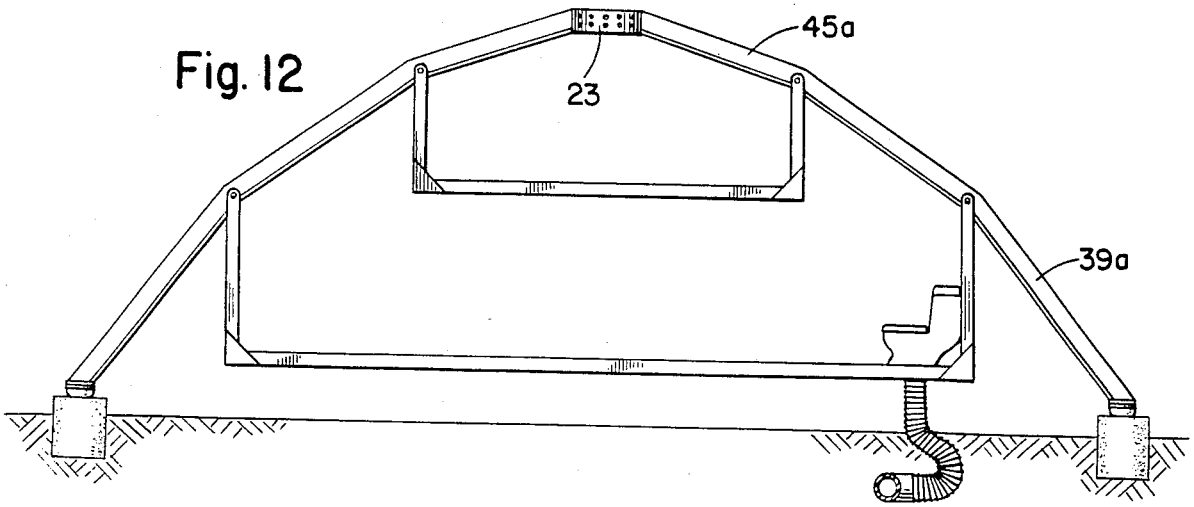

A finished shell structure can be readily transported by air as shown in FIGS. 11*a*, 11*b* and 12. At the top of the structure is a chamber 98 into which can be fitted a helicopter 99, by removing a removable part of the roof structure, the rotor hub 101 protrudes from the roof and the main rotor 102 affixed to a drive shaft 105 which protrudes through the opening in the roof. A tail boom 106 can be affixed to the structure. The exhaust pipe 107 exits from another opening. The steering need not be in the cockpit but can be in a lower part of the structure which can have turning power or tail rotor pedals 108, driving means or cycle pitch stick 109 and lifting power, i.e., collective stick 110. The motor is in a motor hanger 111 where a fuel tank with a fuel tank vent 112 is located. The steering compartment is enclosed by a plexiglass cover 113.

It must be taken into consideration that for many years the sales of mobile homes in the United States have broken all records. The structure described makes it possible to make that kind of a move in time. For example, there is a desperate need to fly a sattelite hospital to a disaster site, or to move a field hospital to a battle site. This can now be done with the structure described.

OUTLINE OF THE STRUCTURE

It is to be observed therefore that the present invention contemplates a dome-shaped building structure having a perimeter 14 which is supported by a plurality of load bearing rib assemblies 15 with a bottom plate **15*a*, said rib assemblies extend from the perimeter 14 up to and are fixedly secured to a locus common to these load bearing assemblies 15. The locus is horizontally within the perimeter and at a substantially vertical height above the ground. A roof deck is fixedly secured to at least a portion of the assemblies, and comprises a plurality of trapezoidal panels 35 to form a closed roof. Also supported by the rib assemblies 15 are a plurality of inverted U-shaped building 39, with side walls 42. Each of these arches 39 have one side wall 42 resting on and supported by one portion of one of the rib assemblies and the other side wall resting on and supported by a portion of another of said rib assemblies 15. At the foot of each rib assembly 15 there is a pier 57 with coupling means 69*a* for connecting the base of each rib assembly to the pier. The ribs forming these rib assemblies have an inverted T-shape in cross section. The trapezoidal panels and arches are held between two adjacent inverted T-shaped ribs. Each rib assembly has a horizontal base 15*a*** used for connecting the rib assembly to its pier.

The pier and coupling means **69*a* consists of a concrete pile with vertical rods 59 having hook ends 61, said pile being reinforced with wire mesh, and with a steel eyelet 67 disposed over the pier 57. An air actuator 69 (commercially available and called an airstroke actuator) is interposed over the eyelet between the pier and rib assembly horizontal base 15*a***. This air actuator serves as a cushion between the structure and the pier to prevent earth tremors from acting on the structure. The main floor can be suspended and hangs from beams.

The various trapezoidal sections and the U-shaped supports with legs are connected using foam strips 53, **53*a*** which are asphalt impregnated and will expand to seal two sections.

Each trapezoidal section and the support 39 consist of a frame 41 with side panels 42 and several ladder-like rungs 43. The top and bottom are made of thermoplastic covers nailed to the frame with nails **45*a*. These frames have apertures 47 and the ribs 15 have corresponding apertures 47*a* allowing the trapezoidal sections to be bolted to the ribs. The U-shaped supports 39** are similarly constructed.

The dome construction hereinbefore described can be placed over a reservoir with filters. The water is kept fresh by pumping fresh air into the reservoir with small motors operated by solar cells. Also, the structure can readily be transported by air and deposited in remote locations.

What is claimed is:

1. A dome-shaped building structure having a perimeter, said structure comprising:

(a) a ring, serving as the common locus of components used to form a roof;

(b) A plurality of flat trapezoidal panels with a narrow top and a wide bottom, the narrow top being coupled to said ring, said panels being assembled one next to the other so as to form a roof, each panel having solid end walls at the top and bottom;

(c) flat trapezoidal sections, with a narrow top and wide bottoms, corresponding in number to said trapezoidal panels, each section having solid end walls at the tops and bottoms, the section tops being sized to fit the bottoms of the roof panels, an asphalt impregnated shim between the panels and sections, with bolts passing through the panel walls and the section walls and the shims so as to couple each section to a panel;

(d) a plurality of flat inverted U-shaped building arches with side walls and top and bottom covers, said side walls, with said top and bottom covers, forming a pair of legs for each of said arches, each of said arches having a top with a top wall, shaped to fit the wide bottoms of said trapezoidal sections, each of said arches top walls and said sections wide bottoms likewise having an asphalt impregnated shim therebetween, and likewise being coupled with bolts passing therethrough, said legs having bottoms defining the bottoms of the arches, said arches corresponding in number to said trapezoidal sections, also a structural base portion affixed to said leg bottoms for use in coupling each leg to a pier;

(e) side walls on each of said panels, said sections and said arches, with bolts passing through the side walls on adjacent panels to securely hold the panels, sections and arches alongside one another to form an enclosed structure; and (f) a pier assembly at the base portion of each of said leg bottoms, to support said dome-shaped structure, said pier assembly including a pier and coupling means, said pier consisting of an elongated concrete pile with vertical rods having hook ends and a central eyelet, said concrete pile being reinforced with wire mesh disposed within said pier, and an actuator interposed over said eyelet between said pier and said structural base portion, said actuator serving as a cushion between the structure and the pier.

* * * * *